United States Patent [19]

Becheiraz

[11] 4,354,755

[45] Oct. 19, 1982

[54] APPARATUS FOR THE PROCESSING OF PHOTOGRAPHIC MATERIAL IN SHEET FORM

[75] Inventor: Joseph Becheiraz, Marly, Switzerland

[73] Assignee: Ciba-Geigy AG, Basel, Switzerland

[21] Appl. No.: 253,958

[22] Filed: Apr. 13, 1981

[30] Foreign Application Priority Data

Apr. 21, 1980 [CH] Switzerland ..... 3061/80
Feb. 25, 1981 [CH] Switzerland ..... 1251/81

[51] Int. Cl.[3] ..... G03D 3/08
[52] U.S. Cl. ..... 354/322; 134/64 P
[58] Field of Search ..... 354/319, 320, 321, 322; 134/64 P, 122 P

[56] References Cited

U.S. PATENT DOCUMENTS

| | | | |
|---|---|---|---|
| 3,000,289 | 9/1961 | Horiuchi | 95/94 |
| 3,592,165 | 7/1971 | Brendel et al. | 118/428 |
| 3,598,086 | 8/1971 | Kushima et al. | 118/602 |
| 3,747,499 | 7/1973 | Foster | 95/94 R |
| 3,760,705 | 9/1973 | Miller | 354/322 |
| 4,255,039 | 3/1981 | Hope et al. | 354/320 |

FOREIGN PATENT DOCUMENTS

| | | |
|---|---|---|
| 1597652 | 5/1970 | Fed. Rep. of Germany . |
| 2043158 | 3/1971 | Fed. Rep. of Germany . |

*Primary Examiner*—L. T. Hix

*Assistant Examiner*—Alan Mathews

*Attorney, Agent, or Firm*—Harry Falber

[57] ABSTRACT

Three uniformly constructed processing stations (A,B,C) are disposed in an apparatus frame (G). Each station comprises a base tank (1) having a central outlet (16), a processing tray (2) and a cover (3) serving simultaneously as guiding means. Between every two adjacent stations (A,B,C) there are disposed transporting and squeezing roller pairs (8) which are driven from a common motor (10) via a beveled gear wheel transmission (**8*a*,8*b*). Each station is equipped with a circulating pump (5) and diverse conduit lines (6,7) which convey treating fluid via a heating means common to all stations into the processing trays. From there the liquids pass by flowing over the tray rims into the base tanks and from there via their discharge outlets (16**) to the circulating pumps.

All stations are standardized by being built up from identical, mutually exchangeable parts which can be assembled and dismantled without the aid of tools. The processing trays (2) are set in the base tanks (1). The roller pairs (8) are grouped in building blocks (8—8). The composite drive shaft (12) consists of identical shaft sections (**12*a*,12*b*,12*c*). When plugging in the roller pair building blocks (8—8), beveled driven gears (8*b*) which sit on extended roller shafts, automatically engage beveled driving gears (8*a*) mounted on the drive shaft sections (12*a*,12*b*,12*c***).

13 Claims, 7 Drawing Figures

APPARATUS FOR THE PROCESSING OF PHOTOGRAPHIC MATERIAL IN SHEET FORM

BACKGROUND OF THE INVENTION

This invention relates to an apparatus for the processing of photographic material in sheet form, comprising several stations arranged in sequence, each of which stations contains a processing tray, a container and circulating means for the treating fluid as well as a pair of transporting and squeezing rollers and guiding elements for conveying the photographic material through the processing apparatus.

In known apparatus of this type (see, for instance, German Offenlegungsschrift No. 15 97 652) the storage containers are designed as tanks which are set up separately or mounted in an apparatus frame, and which are connected with the processing trays via pipe or hose conduits. The upper sheet-guiding means are usually fixedly mounted in the processing trays or are injection-molded integrally with the latter from synthetic thermoplastic resin material. The transporting and squeezing rollers are supported in the container walls or in bearing blocks which are screw-fastened to the apparatus frame. They are driven via conventional gear transmissions, chain or shafts, or a combination of such elements, which can only be dismantled or assembled with the aid of suitable tools. This known type of construction makes it impossible, on the one hand, to achieve a compact assembly, and, on the other hand, renders it difficult to ensure the the flexibility desired for making in a simple manner a change in the number of successively arranged processing stations, especially because of the lack of a suitable embodiment of the roller-driving means.

OBJECT AND SUMMARY OF THE INVENTION

It is, therefore, an object of the invention so to improve a multi-station apparatus of the initially described type that it is very compact as to the space it occupies, and that it can be disassembled and assembled in a simple manner, including the transfer and squeezing roller pairs as well as their drive means, without the aid of any tools. Thereby, the greatest possible flexibility with regard to changes in the number of processing stations is also to be attained. The latter is important, especially for attaining the greatest possible flexibility when, after the assembly of the apparatus, the number of the processing stations is to be changed. The latter is particularly important when the installation is to be subsequently enlarged or reduced in size, or if it is to be adapted to a different and/or a novel developing process.

The stated object is attained, in accordance with the invention, in an apparatus of the initially described type which is characterized by having a frame in which the stations are installed; the container of each station constituting a flat base tank, and the processing tray having an upper rim comprising front and rear longitudinal rim portions opposite each other and lateral rim portions therebetween, and being set in the base tank; a cover which is supported on the said lateral rim portions of the processing tray while leaving a gap or slot free between the cover and the front and rear rim portions, respectively, thereby serving as guide element for the introduction and withdrawal of the photographic material through the two gaps; each pair of rollers constituting a building block per station adapted for being detachably and thereby exchangeably mounted in the base tank-and-processing tray unit of the station; each roller of the roller pair comprising a shaft, and one of the two shafts having an extension part; a composite drive shaft supported in the apparatus frame and composed of drive shaft sections, one per station, and adapted for being detachably connected with each other for rotation in common upon the stations being installed to form said sequence thereof in said apparatus frame, the said composite drive shaft bearing a plurality of drive gear means, one per section being mounted on the drive shaft section of the respective station; and a plurality of driven gear means, one for each station, and mounted on the extension part of one of the roller shafts in the respective building block, in such a manner as to be drivingly engaged by the said drive gear means of a respective station as the building block is plugged into the base tank-and-processing tray unit of that station.

Preferably, the insertion of the roller pair building block occurs by means of a plug-in connection; the two rollers thereof are peferably disposed one above the other, and the shaft of the upper roller preferably comprises the extension part and the driven gear means thereon. The connections between the drive shaft sections to form the composite drive shaft are preferably of the bayonet type.

The two rollers of a roller pair building block are preferably mounted with their shaft ends protruding at opposite sides of the block, in a terminal, roller-shaft bearing element, in particular an end bearing plate, for holding them together, holding means being provided for adjustably holding the two end plates in parallel position and the shafts of the two rollers truly parallel with one another. The terminal bearing elements are so devised that they fit exactly or with a small play between sidewalls of the tank and tray of the same unit, the height of the shaft ends relative to the rim of the processing tray in the unit in each bearing element being adjustable relative to the drive shaft section of the respective station in such a manner that the driven gear means of the respective roller pair building block, engages the drive gear means in the same station.

In a particularly preferred embodiment, each of the aforesaid end bearing plates has two lateral shoulder means on opposite sides thereof and is mounted in a base tank with the shoulders aligned parallel with the drive shaft part of a station, with the bottom end of the end plate resting on the bottom wall of the base tank, one of the shoulders resting on the upper rim of the tank and the opposite shoulder resting on the rim of the tray in the same tank-and-tray unit.

It is also advantageous that the treating fluid circulating means comprise as inlet means a U-tube adapted for introducing fluid into a bottom zone in the said processing tray, a feed line for fluid, and a rapidly separable fluid tight connection means between the said feed line and the U-tube.

The base tank can have a peripheral sidewall and a bottom, and the latter is preferably slanted downwardly and inwardly from the periphery of the bottom toward the center thereof. A discharge outlet can be disposed in the center of the inwardly slanted bottom and the processing tray which also preferably has a bottom having its lowest portion at the center thereof, can rest with its central bottom portion on the inside of the bottom of the base tank, fluid passages being provided between the outside of the tray bottom and the inside of the tank bottom to provide a passage for fluid to the said discharge outlet.

In a particularly preferred embodiment, the bottom of the processing tray is provided with holes the sum of all cross sectional areas of these holes being substantially smaller than the cross sectional area of the said inlet means.

In the apparatus according to the invention, all essential parts can be assembled by plugging-in one part into another, and each station including the block of rollers pertaining thereto and their drive is built up of parts essentially or completely indentical with those of all other stations, so that these parts can be readily interchanged.

The single station apparatus having the known "tray-in-tank" (or "tray-in-bowl") arrangement with a cover designed as an upper guidance for sheet material, which station has been disclosed, e.g. in U.S. Pat. No. 3,598,086, constitutes one of the prior art elements used in the novel combination of features constituting the apparatus according to the invention. In the latter it is decisive that a plurality of such stations has been combined with novel building blocks of roller pairs, adapted for being plugged in other parts, and a composite drive shaft, composed of shaft parts all of which are of equal length, bearing identical gear means in identical locations in each station, thus completing a standardized structure identical for each station.

This standardized structure permits the assembly of a random number of stations to obtain each time a complete, operable apparatus. In order to carry out normal photographic processes, a sequence of the standardized stations, e.g. for developing, stopping and fixing baths in processing a black-and-white photographic material, is usually sufficient. Also, when processing color-photography material, three stations, e.g. one each for a developing, a bleaching and fixing, and a stabilizing bath for chromogenic material will generally suffice. By adding one or several stations, the apparatus can also be adapted to processes which require a larger number of processing baths.

BRIEF DESCRIPTION OF THE DRAWINGS

Further details of the invention shall now be explained at the hand of the accompanying drawings which illustrate a preferred embodiment of the apparatus according to the invention; in the drawings

DETAILED DESCRIPTION OF THE EMBODIMENT SHOWN IN THE DRAWINGS

Figure 1:
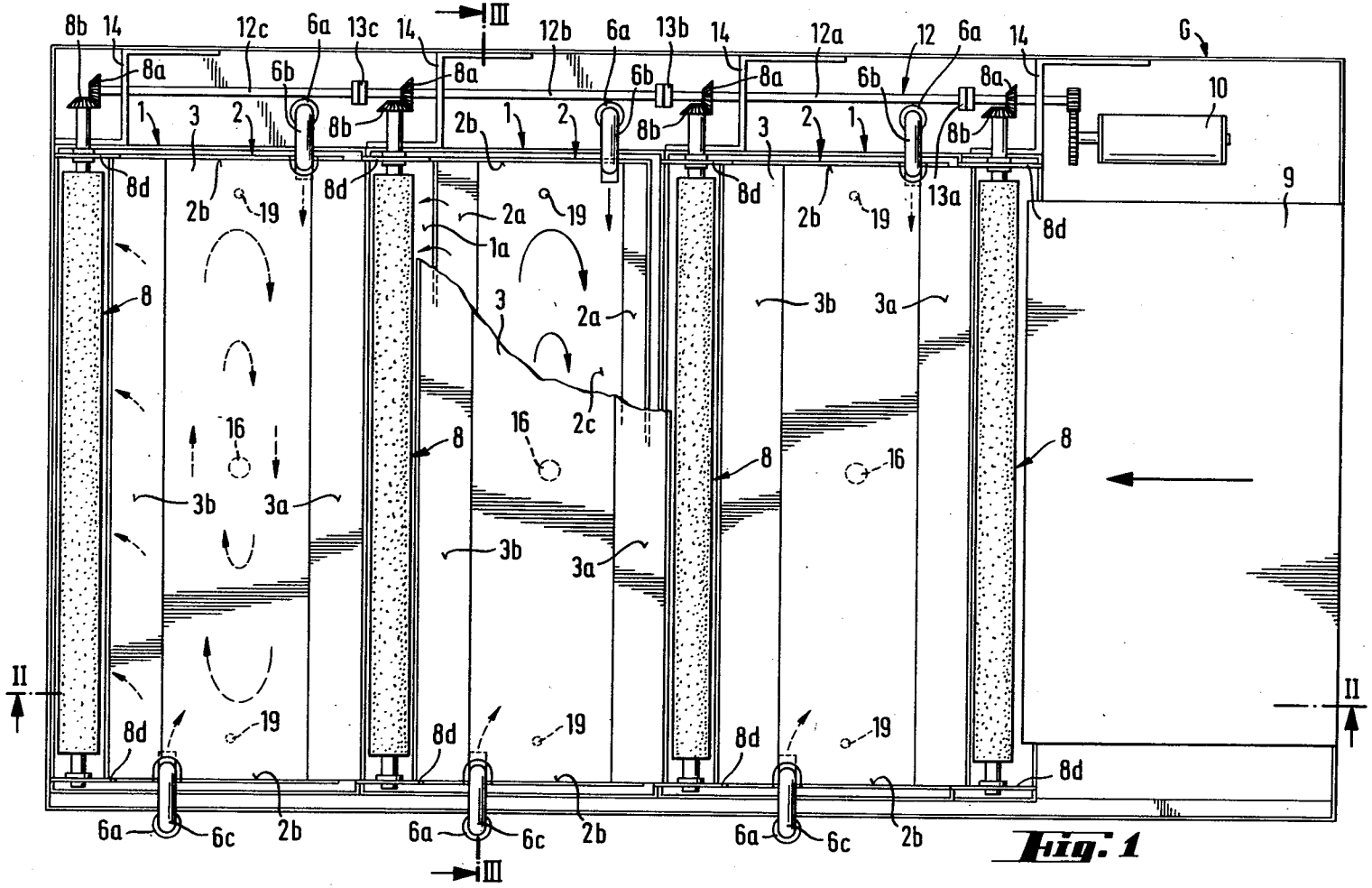
FIG. 1 is a plan view of the embodiment.
Figure 2:
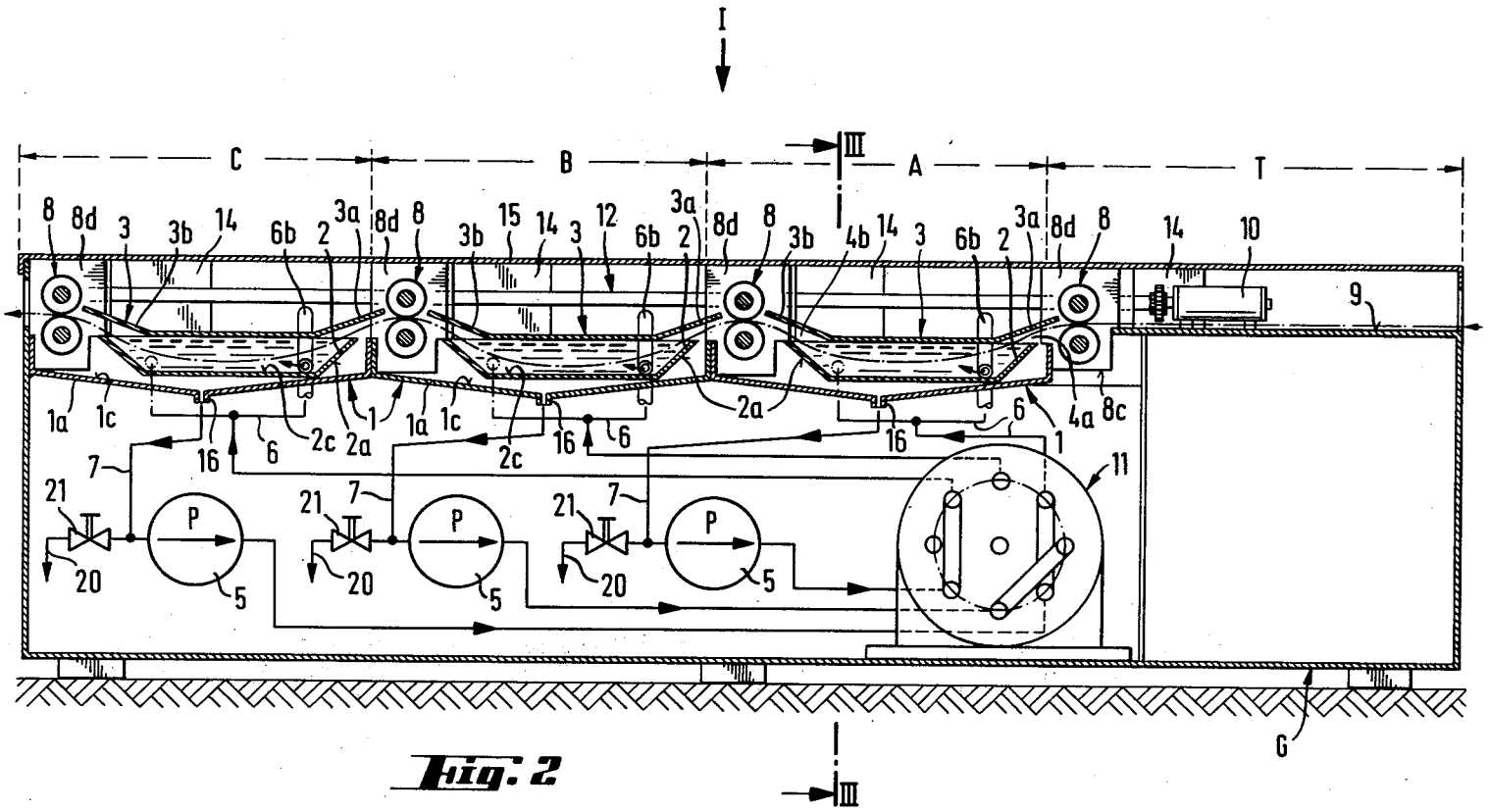
FIG. 2 is a sectional view in a plane indicated by II—II in FIG. 1.

The illustrated apparatus comprises three processing stations A, B and C, of identical structure, which are mounted in a frame G. The lower part of the frame contains, for each station, a recycling pump 5 with a supply line 6 and a return line 7 for the treatment fluid, wherein the supply lines 6 are arranged to pass through a heating block 11 which can be held at a desired temperature by an adjustable thermostat (not illustrated). Above the recycling pump 5, of each station, there is provided a base tank or bowl as a container for the treating liquid, the bottom 1*a* of which is flatly inclined downwardly on all sides toward the center of the bottom. At the center, the tank bottom 1*a* is provided with a discharge outlet 16 for the treating liquid which outlet is connected with the recycling pump 5 via the return line 7. In each station, a processing tray 2 is so placed in the base tank 1 that it stands with its bottom wall on a peripheral range of the inner surface of the downwardly and inwardly inclined tank bottom. The processing tray 2 which is preferably of rectangular outlay is delimited on short end sides opposite one another by vertical walls 2*b*, while the two long walls 2*a* are slanted outwardly and upwardly from the flat tray bottom 2*c*, as shown in FIGS. 1 and 2.

Figure 3:
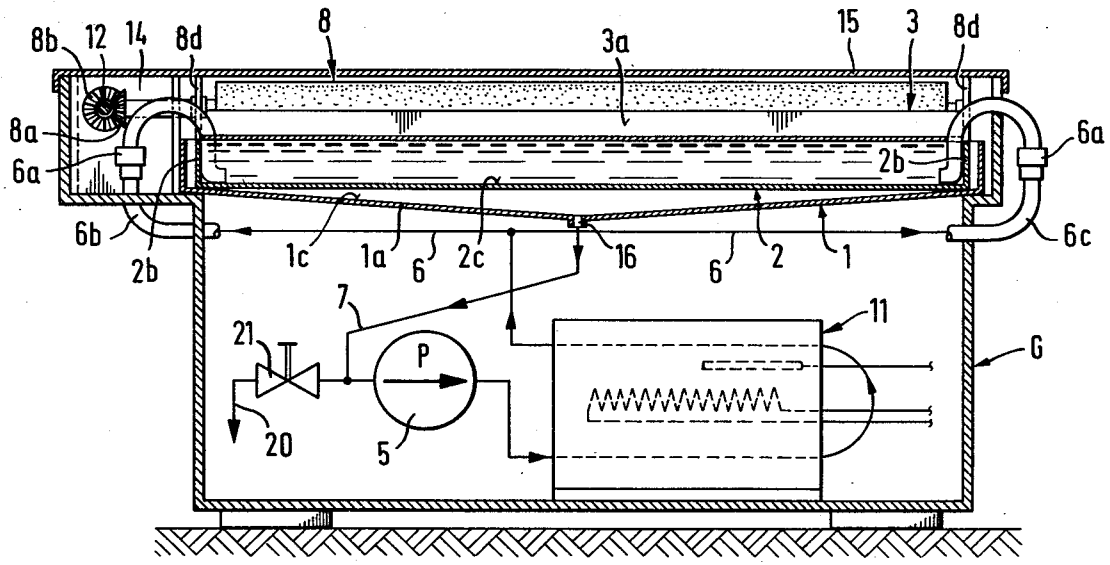
FIG. 3 is a sectional view in a plane indicated by III—III in FIG. 2, FIG. 4 a frontal view of a roller building block, which can be plugged in, FIG. 5 a top partial view showing the roller drive coupling arrangement of two roller building blocks, FIG. 6 a sectional view of the roller drive coupling arrangement taken along a plane indicated by VI—VI in FIG. 5, and FIG. 7 a sectional view of an upper portion of the apparatus showing a plugged-in building block of a roller pair, taken in a plane indicated by VII—VII in FIG. 6.

On the vertical end walls 2*b* of the tray 2, there rests a cover or lid 3 which covers the open upper side of the tray 2 with the exception of two gaps or slots, one of which serves as the entry slot 4*a* and the other as the exit slot 4*b* for the photographic sheet material being processed. These slots 4*a* and 4*b* are formed between the long tray walls 2*a* which are inclined from the upper tray rim downwardly and inwardly, and the downwardly and inwardly vaulted or angularly inclined cover wall portion 3 *a* above these tray walls 2*a*. Each of the processing trays 2 is equipped with one or several supply inlet pipes 6*b* and 6*c*, at opposite end walls 2*b* of each tray 2, for the treating liquid (FIG. 3).

These inlet pipes 6*b* and 6*c* are preferably shaped as U-tubes which are connected at their one end outside the base tank 1 with the supply line 6 by means of an easily detachable quick coupling means 6*a*, while their other ends protrude through openings in the cover 3 into the interior of the processing tray 2.

The processing trays 2 are each provided with two small holes 19 in their bottoms 2*c*, through which holes some treating liquid can flow into the base tanks 1 underneath. The diameter of each hole is so small that the liquid level in the tray 2 is not changed during normal operation.

On the entry side of each of the stations A, B and C and at the exit side of station C there are provided transport roller pairs 8; the surface of the rollers is covered with a layer of elastic material which is resistant to the respective treating fluid.

The distance between the roller pairs of adjacent stations is shorter than the length of the smallest size sheet of the photographic material to be processed. Each pair of rollers 8 comprises, on an extension of the shaft of one of its two rollers, a beveled gear 8*b* which engages a second beveled gear 8*a* which is mounted on a composite drive shaft 12, the latter being driven from an electric motor 10. The transport roller pairs 8, with the exception of a pair located at the entry side of the first station, in the direction of transport of the photographic material, act simultaneously as squeezing rollers.

Each combined pair of transport and squeezing rollers constitutes a unit serving as a building block which can be mounted into, and moved as a whole from a station, without requiring the use of any tools.

The drive shaft 12 is composed of shaft parts 12*a*, 12*b* and 12*c* all of which are of equal length and structure, and bear each a beveled gear 8*a* near the shaft part and remote from the first pair of feeding rollers, at the entry side of station A. These shaft parts are connected with each other in sequence for rotation in common by suitable connecting means 13*a*, 13*b* and 13*c* which are preferably bayonet connections.

The drive motor 10 is preferably of the type having means for varying its r.p.m. number or can be equipped with a variable gear box.

On the entry side of the first station A, there is provided a table 9 which assists in introducing into the apparatus the photographic material to be processed. The entire apparatus can be protected by a cover hood 15.

Figure 4:
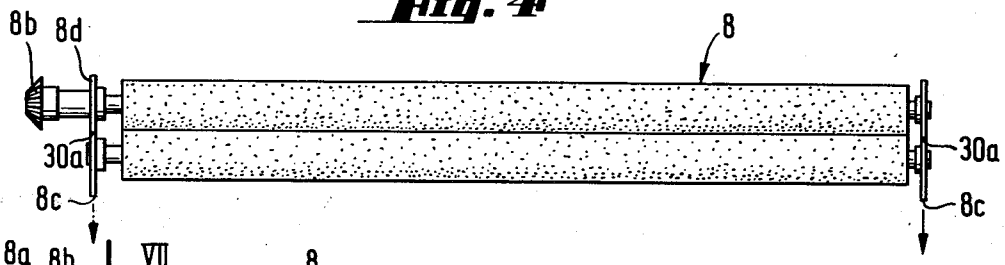
Figure 6:
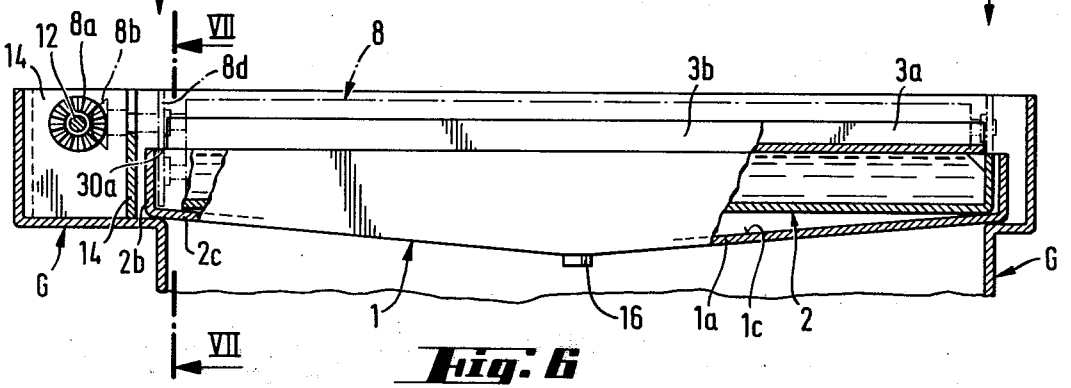
Figure 5:
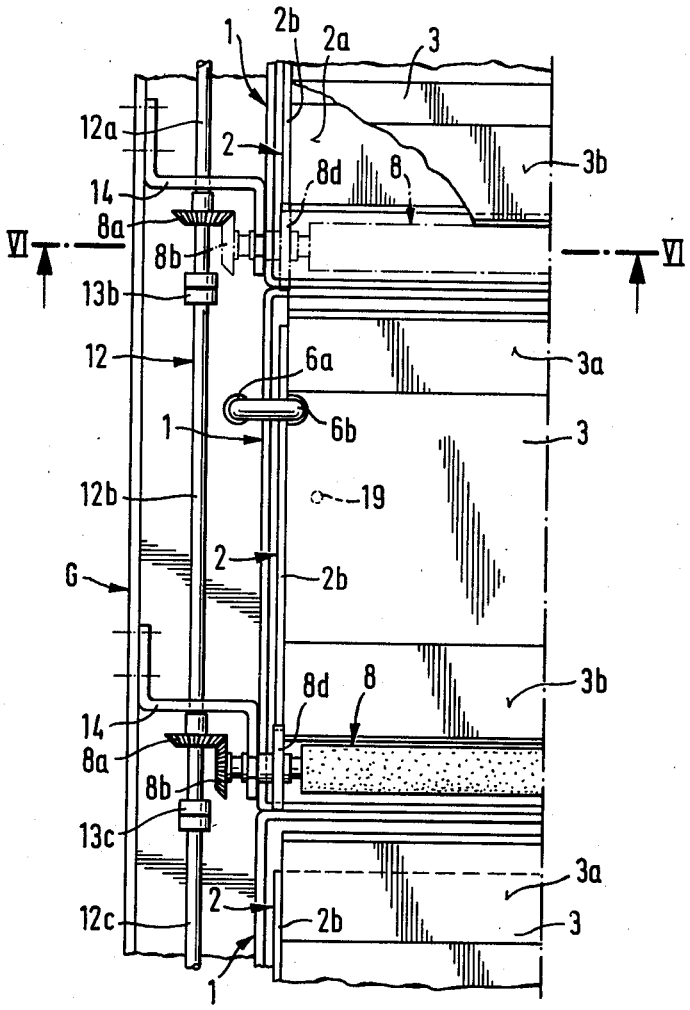

FIGS. 4 to 7 show details of the plug-type drive connections. FIG. 4 shows one of the building blocks comprising two rollers 8. The shafts of the two rollers 8 are mounted without any axial displacement or with very small axial play in two end plates 8*d*. The shaft of the upper roller has an extension beyond the respective end plate 8*d*, which extension bears the beveled gear 8*b*.

Figure 7:
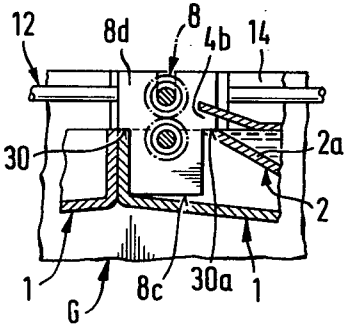

The two end plates 8*d* are of such configuration that they fit exactly or with little play between the base tank 1 and the processing tray 2 therein. Preferably, as shown in FIG. 7, the two end plates 8*d* are supported with a first shoulder 30 on the upper rim of the tank 1 and with a second shoulder 30*a*, provided in the opposite edge of end plate 8 on the upper rim of the tray in the same tak while the bottom edge 8*c* of the end plate 8 rests on the inner side of the tank bottom 1*c*. This arrangement also affords a mutual fastening of the tank 1 and tray 2 relative to each other and to the roller building block 8,8.

Instead of the end plates 8*d*, other terminal roller shaft-bearing elements can also be used. The two plates 8*d* or other elements can be connected with rods (not shown) in order to impart greater stability to the building block 8—8.

The driving shaft 12 or the drive shaft sections 12*a*, 12*b* and 12*c* thereof, are supported by means of struts such as angle plates 14 mounted in the frame G. The drive shaft sections can be easily inserted into holes in the angle plates and can be connected with one another by means of rotary couplings 13*a*, 13*b* and 13*c*. The geometry of the arrangement is such that, in assembled state, the beveled driven gears 8*b* of the roller building blocks 8—8 are in engagement with the drive gears 8*a* on the drive shaft sections.

In operation, each of the stations A, B and C is fed the respectively required treating fluids which are, as a rule, a developer, a bleaching agent and a fixing agent. The ciculating pump 5 associated with each station conveys the treating liquid via the supply line 6 and through the heating means 11 which is common to all stations, to the processing tray 2 of the same station, from where it overflows into the base tank 1 and is returned from there through the discharge outlet 7 of the latter to the pump 5. The two U-shaped inlet pipes 6 *b* and 6*c* are disposed diagonally opposite each other, each at one of the respective frontal vertical walls 2*b* of the processing tray 2. This diagonal disposition of the U-tubes ensures a better distribution of the treating fluids in the processing trays 2. Due to the constant influx of treating liquid there also occurs a continuous overflow of liquid over the edges of the longitudinal rim portions of the processing tray 2 through the slots between these rim portions and the cover 3.

This constant introduction and overflow of treating fluid ensures, moreover, that the fluid wets completely the underside of the cover 3 resting on the processing tray 2.

The return line 7 can pass through the heating unit 11 together with, or instead of, the supply line 6. The amount of treating fluid required depends, of course, on the size of the apparatus, the dimensioning, i.e. the volume of the processing tray 2 and of the circulating lines, being preferably chosen such that always one liter of fluid per station is caused to circulate in the apparatus. As experience has shown, this relatively small amount of liquid corresponds best to the requirements of amateur photographers.

The illustrated embodiment of the apparatus according to the invention is especially well suited for the processing of exposed black-and-white or color material in sizes between from about 18 cm×24 cm to 30 cm×40 cm. In the direction of transport the transverse dimension must not exceed the length of the processing tray, and the longitudinal direction must be at least equal to the distance between two neighboring transport roller pairs. The sheet of photographic material is placed, with its face bearing the exposed photographic layer as the underside, on the table 9 and is advanced between the rollers of the first pair 8 and is conveyed by these rollers via the slot 4*a* between the processing tray 2 and the cover 3 into the treating fluid in the processing tray 2 of the first station A, the cover 3 serving as guide for the material. After passing through the treating liquid in this processing tray 2, the sheet material exits from the tray via the slot 4*b* between the longitudinal rim portion of the downstream wall 2*a* of the tray and the cover 3 and is seized by next following transport roller pair 8 which squeezes off a large portion of the adherent liquid and conveys the sheet material to the next following station B. After passing through the last station C of the apparatus embodiment shown, the last transport roller pair withdraws the fully processed sheet material from the last station C and expels it from the apparatus. The sheets can then be washed in water and dried.

The capacity of the apparatus depends on the available amounts of treating fluids circulating in the individual stations A, B and C. The amount of liquid volume needed for processing per surface unit of the material can vary dependent on the kind of photographic material and the type of processing method employed.

In order to process color photographs by the silver color bleach process, one liter of liquid is required for a photographic material having a size of from 0.6 to 0.7 $m^2$ which corresponds to about 12 to 14 pictures of a size of 20 cm×25 cm. After the baths are exhausted, the bath liquid can be withdrawn from the respective stations and discarded. The discharge of exhausted liquid from the processing tray 2 is effected via the small holes 19 in the bottom of the tray and each of a discharge line 20, equipped with a tap valve 21, which line 20 is connected to the return lines 7.

What is claimed is:

1. An apparatus for the processing of photographic material in sheet form, comprising at least two stations, an apparatus frame in which said stations are installed in sequence, each of said stations comprising a flat base tank having a sidewall, an upper rim and a bottom wall; a processing tray having a sidewall, a bottom zone and an upper rim comprising front and rear longitudinal rim portions opposite each other and lateral rim portions therebetween, and being set in said base tank so as to constitute a tray-and-tank unit; guiding elements for conveying the photographic material through the processing apparatus, comprising a cover which is supported on said lateral rim portions of said processing tray while leaving a slot free between the cover and the front and rear rim portions, respectively, said cover thereby guiding the introduction and withdrawal of the photographic material through said two slots; each station comprising a pair of transporting and squeezing rollers constituting a roller pair-building block adapted for being detachably and thereby exchangeably mounted in the tank-and-tray unit of the station; each roller of said roller pair comprising a shaft, and one of the two shafts having an extension part laterally protruding beyond said tank; a composite drive shaft supported in said apparatus frame and composed of drive shaft sections, one per station, and adapted for being detachably connected with each other, for rotation in common, upon the stations being installed to form said sequence thereof in said apparatus frame, a plurality of drive gear means, one per section being mounted on the drive shaft section of the respective station; and a plurality of driven gear means, one for each station, being mounted each on said extension part of one of the roller shafts in the respective building block in such a manner as to be drivingly engaged by said drive gear means of the same station, as the respective building block is inserted into the tank-and-tray unit of that station; and circulating means for circulating treating fluids through said stations.

2. The apparatus of claim 1, wherein each roller pair building block comprises plug-in means for connection with said tray-and-tank unit.

3. The apparatus of claim 1 or 2, wherein the two rollers of each block are disposed one above the other, the shaft of the upper roller comprising the extension part and the driven gear means thereon.

4. The apparatus of claim 1, wherein said composite drive shaft comprises bayonet type connecting means for connecting said drive shaft sections with each other.

5. The apparatus of claim 1, wherein the two rollers of said roller pair building block are mounted with their shaft ends protruding at opposite sides of said block, said block comprising on each of said opposite sides thereof a terminal roller-shaft bearing element for holding said shafts together, and holding means for adjustably holding the two bearing elements in parallel position and said shafts of said two rollers truly parallel with one another.

6. The apparatus of claim 5, wherein said terminal bearing elements are so devised that they fit exactly or with a small play between sidewalls of said tank and said tray of the same tray-and-tank unit.

7. The apparatus of claim 6, wherein each bearing element comprises means for adjusting the height of the shaft ends relative to the rim of the processing tray in the same unit.

8. The apparatus of claims 5, 6 or 7, wherein said bearing elements are adjustable relative to the drive shaft section of the respective station in such a manner that the driven gear means of the respective roller pair building block, engages the drive gear means in the same station, upon said block being plugged into said station.

9. The apparatus of claim 8, wherein each of said bearing elements in a bearing element has two lateral shoulder means on opposite sides thereof and a bottom end, and is mounted in said base tank of the respective tray-and-tank unit with the shoulder means aligned parallel with the drive shaft part of the respective station and the bottom end thereof resting on the bottom wall of said base tank, one of said shoulder means resting on the upper rim of said base tank and the opposite shoulder means resting on the rim of the tray in the same tank-and-tray unit.

10. The apparatus of claim 1, wherein said treating fluid-circulating means comprise as inlet means a U-tube adapted for introducing fluid into the bottom zone in said processing tray, a feed line for fluid, and a rapidly separable fluid tight connection means between said feed line and said U-tube.

11. The apparatus of claim 10, wherein said bottom wall of said base tank is slanted downwardly and inwardly from the periphery of said bottom wall toward the center thereof, and a discharge outlet is disposed in the center of said bottom wall.

12. The apparatus of claim 11, wherein said processing tray has a bottom having its lowest portion at the center thereof, and rests with its central bottom portion on the inside surface of said bottom of said base tank, and further comprises fluid passages between the outside of said tray bottom and the inside of said tank bottom for the passage of fluid to said discharge outlet.

13. The apparatus of claim 12, wherein the bottom of the processing tray is provided with holes the sum of all cross sectional areas of which holes is substantially smaller than the cross sectional area of the said inlet means.

* * * * *